US007182609B1

(12) United States Patent
Chen

(10) Patent No.: US 7,182,609 B1
(45) Date of Patent: Feb. 27, 2007

(54) MODULAR POWER INTEGRATED BOARD

(75) Inventor: Michael Chen, Taipei Hsien (TW)

(73) Assignee: Topower Computer Industrial Co., Ltd., Taipei (TW)

( * ) Notice: Subject to any disclaimer, the term of this patent is extended or adjusted under 35 U.S.C. 154(b) by 0 days.

(21) Appl. No.: 11/505,342

(22) Filed: Aug. 17, 2006

(51) Int. Cl.
*H01R 12/00* (2006.01)

(52) U.S. Cl. ..... 439/78; 439/81

(58) Field of Classification Search ..... 439/78, 439/81, 83, 79, 581
See application file for complete search history.

(56) References Cited

U.S. PATENT DOCUMENTS 4,494,308 A * 1/1985 Schauer ..... 29/858
4,726,778 A * 2/1988 d'Agostino et al. ..... 439/78
4,743,205 A * 5/1988 Mitani et al. ..... 439/78
5,046,956 A * 9/1991 Takano ..... 439/78
5,380,222 A * 1/1995 Kobayashi ..... 439/590
7,086,871 B2 * 8/2006 Park ..... 439/78

* cited by examiner

*Primary Examiner*—Hien Vu
(74) *Attorney, Agent, or Firm*—Birch, Stewart, Kolasch & Birch, LLP

(57) ABSTRACT

The present invention discloses a modular power integrated board that includes a plurality of power pin holes on a power integrated board for outputting electric power and installs a plurality of first conductive connecting members, such that the power integrated board can perform an electric potential detection process, and users can install at least one second conductive connecting member electrically coupled to the first conductive connecting members based on the specification of the power cable of the power integrated board to constitute a modular design that adopts a power integrated board to fit the connection of power cables of different specifications.

2 Claims, 5 Drawing Sheets

MODULAR POWER INTEGRATED BOARD

FIELD OF THE INVENTION

The present invention relates to a modular power integrated board, and more particularly to a power integrated board that includes an electric potential detection process for its manufacture and selects an appropriate specification of a power cable based on the using conditions, so as to achieve a modular design of the power integrated board.

BACKGROUND OF THE INVENTION

Computer technologies are advanced rapidly to cope with the increasingly high demands on Internet and multimedia functions, and thus related hardware such as hard disk drives, optical disk drives and burners have become basic equipments for server users and manufacturers. The output of a power supply required for supplying electric power is increased accordingly, and the past basic power of 250 W is no longer applicable, and it is necessary to increase the power to 450 W or even up to 500 W or 600 W to meet the power requirements of computer hardware equipments.

Referring to FIG. 1 for a schematic view of a power integrated board of a power supply in accordance with a prior art, a power integrated board 10 integrates the output power circuit to an area, since the space and wiring of the power cables has to be taken into consideration for the design, and a wire end 121 of every power cable 12 is inserted into a power pin 11 in the area, and then soldered, such that the electric power can be conducted from the power integrated board 10 to the power cable.

Since the foregoing power supply is soldered, the inflexible design will cause inconvenience for users and manufacturers because there are various different specifications of connectors such as a 4-pin peripheral power connector (generally known as large 4P) and a 15-pin serial ATA power connector (generally known as SATA) for the present power supplies. To meet consumer requirements, power supply manufacturers provide all large 4P power supplies, or all SATA power supplies, or half of the large 4P power supplies and half of the SATA power supplies For instance, a user finds out that there are insufficient SATA connectors in the original power supply when the user needs to install a new SATA hardware. Therefore, the user has to change the power supply to one with sufficient SATA connectors. As to manufacturers, a single power integrated board cannot support so many specifications, and thus creating a burden to the inventory management. To comply with the regulations and specifications of environment protections such as the "Restriction of Hazardous Substances (RoHS) for Electrical and Electronic Products", and thus the consumption of lead capable of improving the yield rate of soldering is reduced greatly, and the yield rate of soldering the power integrated board is affected adversely. After the soldering is completed, manufacturers can determine whether or not to solder again from the electric potential detection process, and the process will waste tremendous time and efforts.

SUMMARY OF THE INVENTION

The primary objective of the present invention is to overcome the foregoing shortcomings and avoid the existing deficiencies by connecting a first conductive connecting member and a second conductive connecting member to conduct the power cable and the power integrated board in order to provide a flexible way of connecting a power supply for the output of electric power. The invention not only complies with the requirements of lowering costs for consumers and manufacturers, but also achieves the purpose of environmental protections.

To achieve the foregoing objective, the present invention provides a modular power integrated board, comprising: a power integrated board, having a plurality of power pins disposed thereon; a plurality of first conductive connecting members, having a first electric connecting portion fixed to the power pins and a second electric connecting portion electrically coupled to the first electric connecting portion; a plurality of power cables, each having at least one second conductive connecting member on the power cable, and a second conductive connecting member, having a third electric connecting portion electrically coupled to the second electric connecting portion and a fourth electric connecting portion electrically coupled to third electric connecting portion and connected to the power cable.

DETAILED DESCRIPTION OF THE PREFERRED EMBODIMENTS

The technical characteristics and effects of the present invention are described in details by a preferred embodiment together with the attached drawings as follows.

Figure 1:
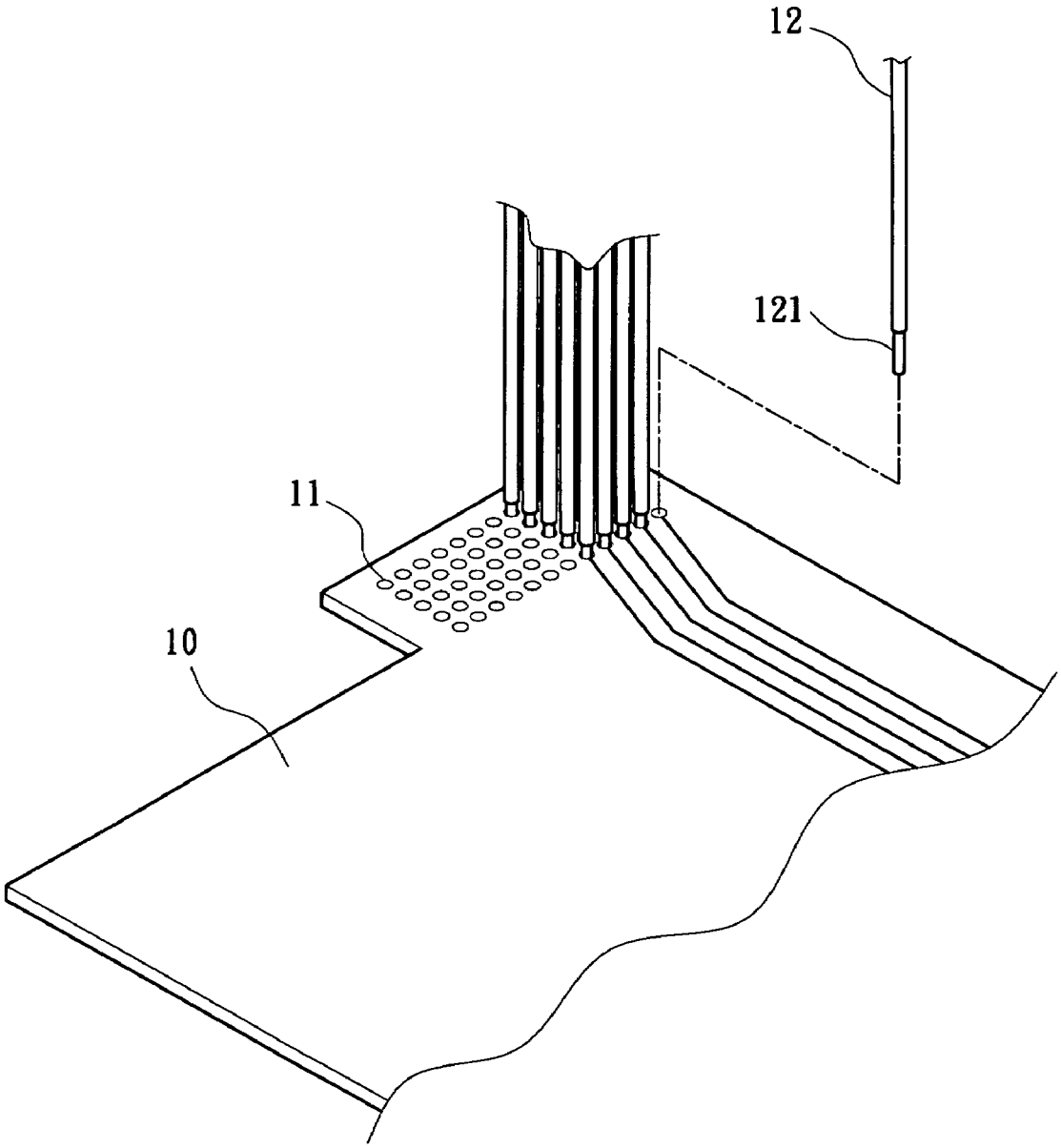
Fig. 1 PRIOR ART
FIG. 1 is a schematic view of a power integrated board of a power supply in accordance with a prior art.
Figure 2:
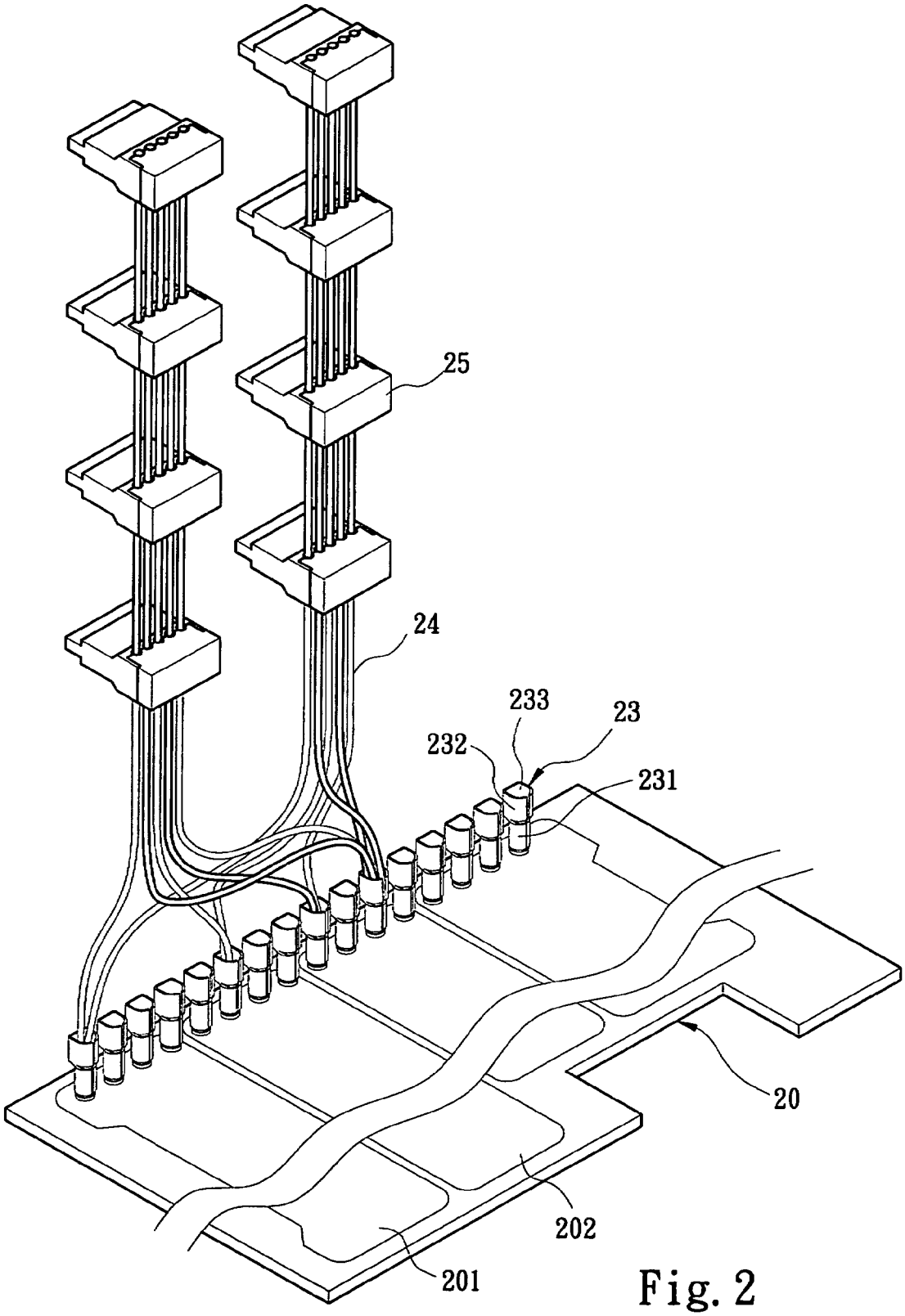
FIG. 2 is a perspective view of a preferred embodiment of the present invention.
Figure 3:
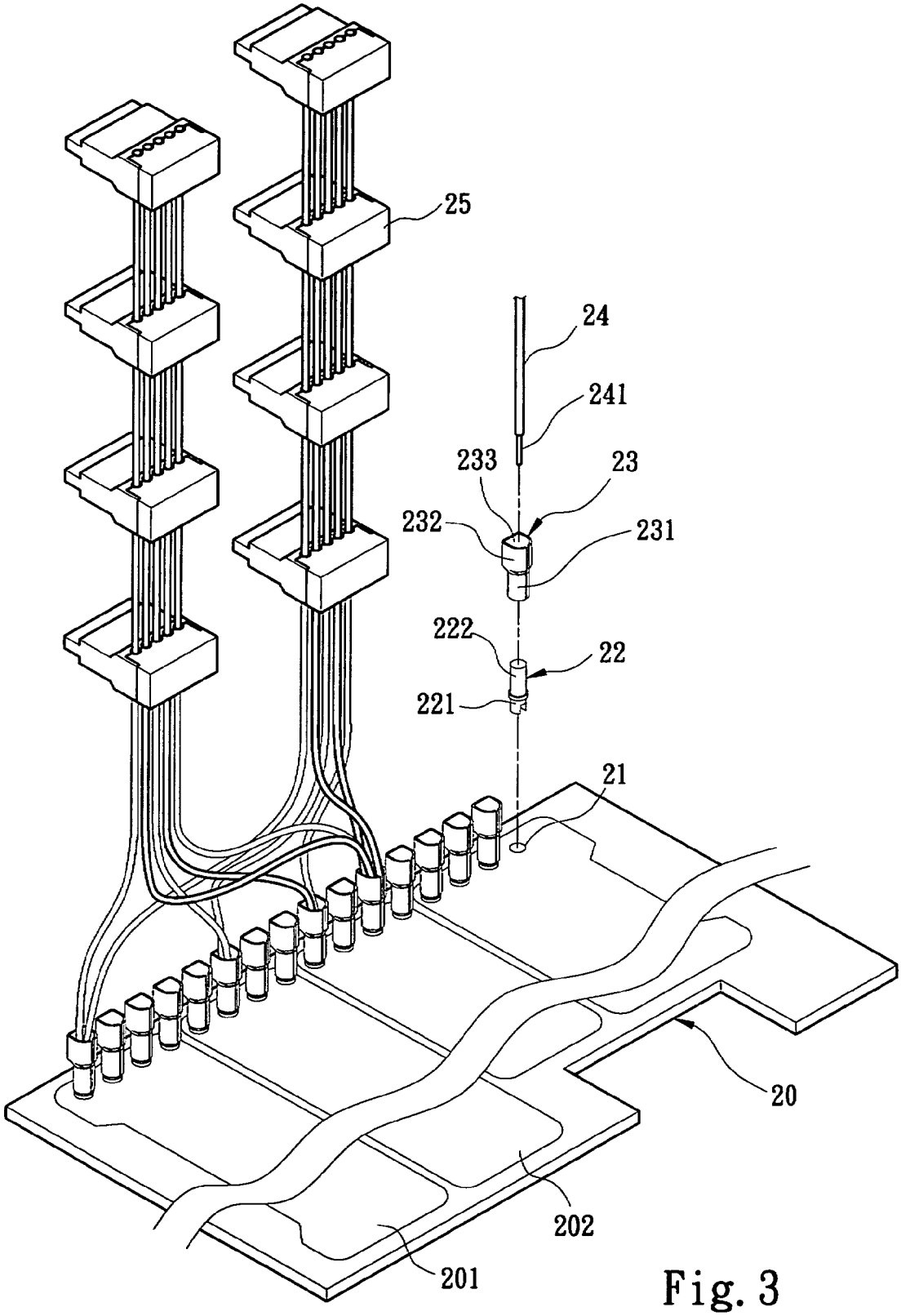
FIG. 3 is an exploded view of a structure in accordance with a preferred embodiment of the present invention.

Referring FIGS. 2 and 3 for a perspective view and an exploded view of a preferred embodiment of the present invention, a modular power integrated board comprises a power integrated board 20, and a plurality of power cables 24 and at least one set of conducting connecting members, wherein the set of conductive connecting members includes a first conductive connecting member 22 fixed to the power integrated board 20 and at least one second conductive connecting member 23 electrically coupled to the first conductive connecting member 22 and the power cables 24, and the power cables 24 are connected to a plurality of connectors 25.

The power integrated board 20 includes a plurality of electric potential areas 201, 202, and each electric potential area 201, 202 has a plurality of power pin holes 21. In this embodiment, the electric potential areas 201, 202 supply different voltage levels to provide different voltages to different power cables 24. After the power pin holes 21 are installed in the electric potential areas 201, 202 of the power integrated board 20, manufacturers can determine whether or not it is necessary to solder again from the electric potential detection process, and thus greatly reducing the time and efforts for the electric potential detection process.

The first conductive connecting member 22 includes a first electric connecting portion 221 fixed to the power pin holes 21 and a second electric connecting portion 222 electrically coupled to the first electric connecting portion 221. In this embodiment, the first conductive connecting member 22 is a cylindrical metal member formed by an integral stamping.

Figure 4A:
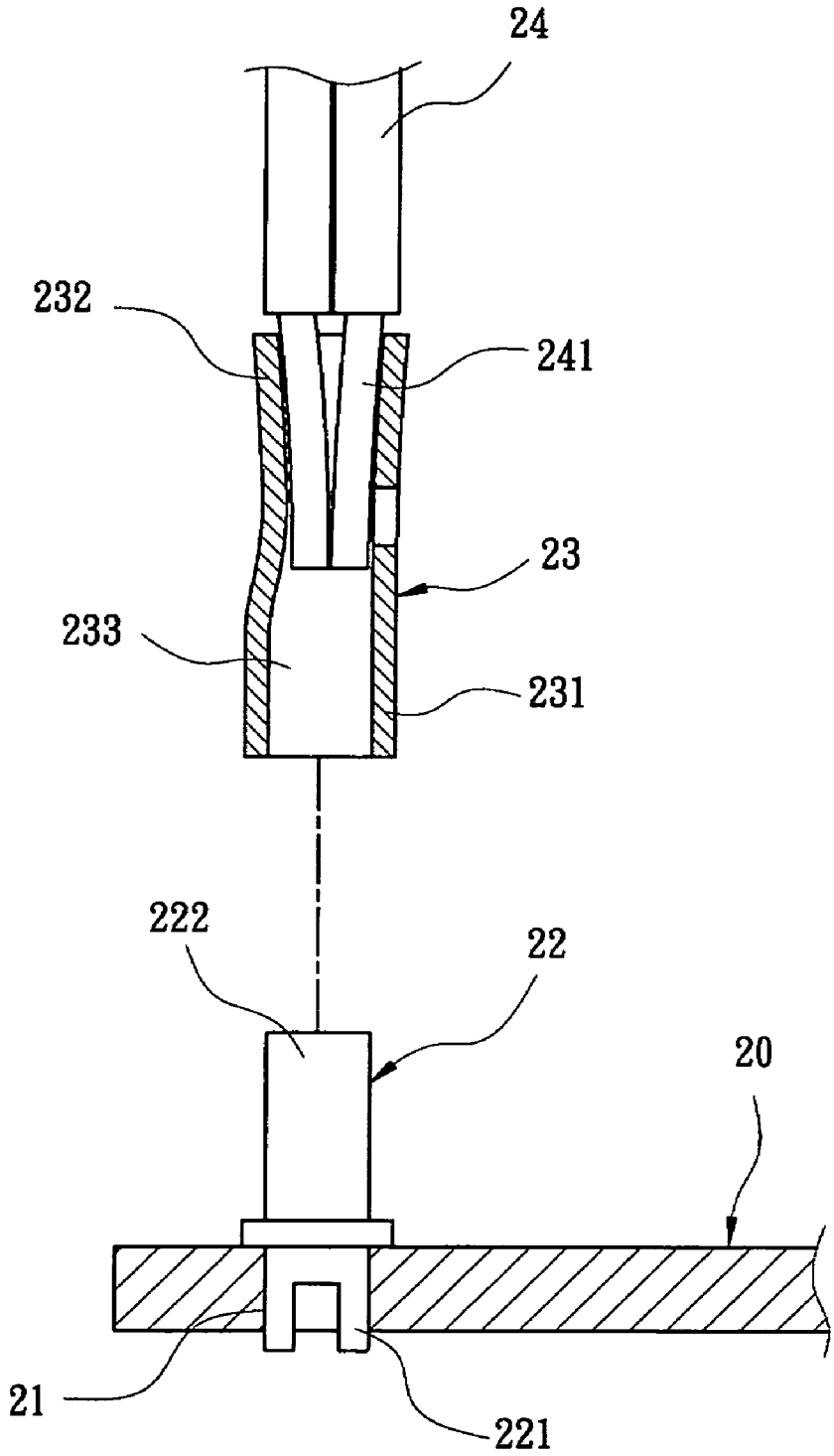
FIG. 4A is a schematic view of a portion of an assembly of a preferred embodiment of the present invention.
Figure 4B:
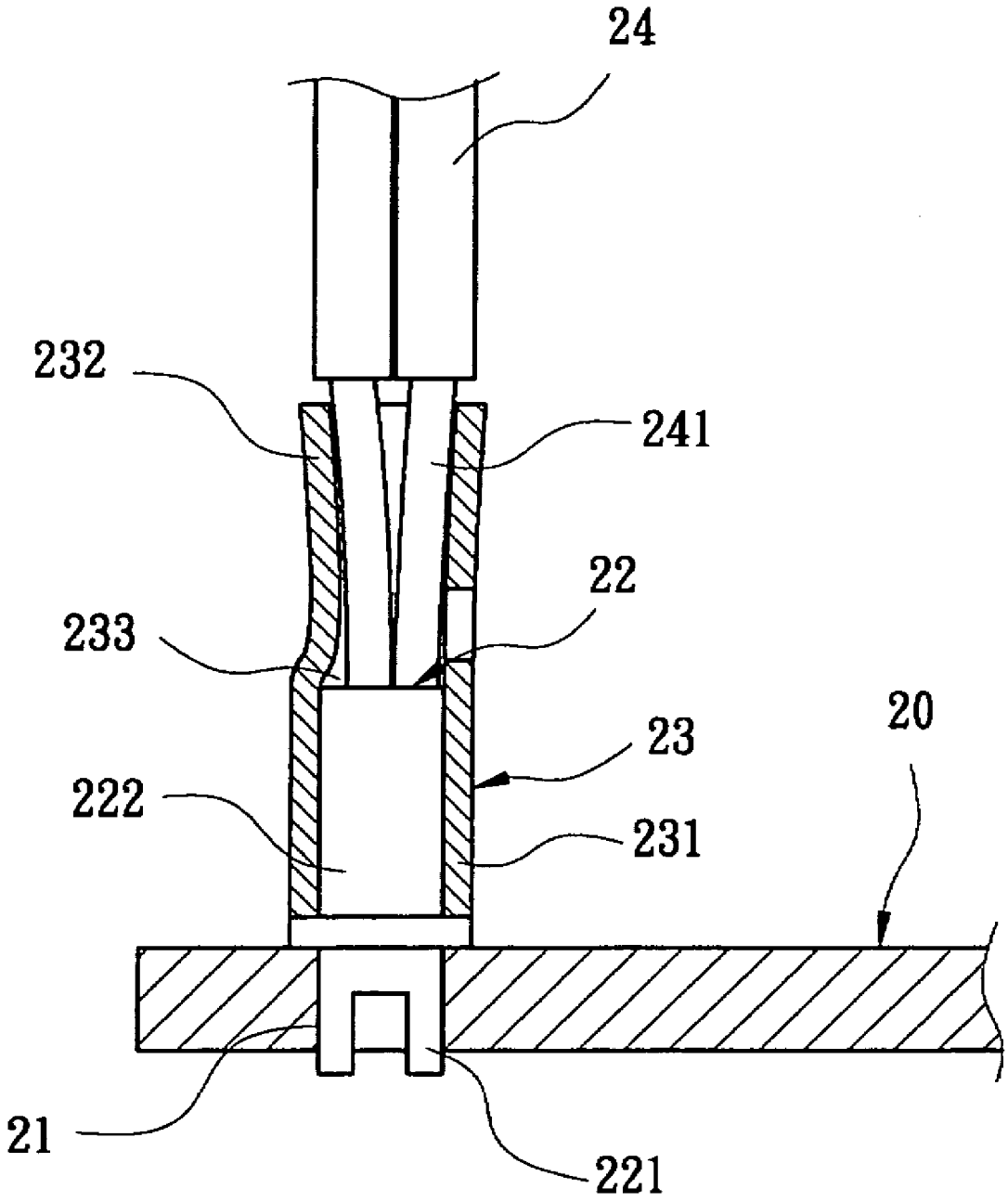
FIG. 4B is a schematic view of another portion of an assembly of a preferred embodiment of the present invention.

Refer to FIGS. 4A and 4B respectively for schematic views of portions of an assembly in accordance with a preferred embodiment of the present invention.

The second conductive connecting member 23 includes a third electric connecting portion 231 electrically coupled to the second electric connecting portion 222 and a fourth electric connecting portion 232 electrically coupled to the third electric connecting portion 231 and connected to the power cable 24. In this embodiment, the second conductive connecting member 23 is a hollow metal cylindrical body made by an integral stamping, and the second conductive connecting member 23 has a containing space 233, and the containing space 233 is coupled to the second electric connecting portion 222 along the direction of the third electric connecting portion 231 and coupled to an electric conducting terminal 241 of the power cable 24 along the direction of the fourth electric connecting portion 232, wherein the electric conducting terminal 241 of the power cable 24 is connected to the second electric connecting portion 222 and disposed in the containing space 233, and then the electric conducting terminal 241 is soldered to the second electric connecting portion 222 or the third electric connecting portion 231 to improve the connecting strength between the power cable 24 and the first conductive connecting member 22. Further, the central position of the second conductive connecting member 23 is tapered to bind a plurality of power cables 24.

When the power cable 24 is inserted into the second conductive connecting member 23, the central position of the second conductive connecting member 23 binds a plurality of electric conducting terminals 241 of the power cable 24, and the electric conducting terminals 241 are connected to the second electric connecting portion 222, such that the electric power can be passed from the power integrated board 20 to the power cable 24 through the electric potential areas 201,202, power pin holes 21, and first conductive connecting member 22.

In summation of the description above, the present invention utilizes the first conductive connecting member 22 and the power pin holes 21 to perform an electric potential detection process for the power integrated board 20 to avoid any waste of time and efforts. Further, users can install the second conductive connecting member 23 of the power cable 24 to electrically conduct the first conductive connecting member 22 based on the specification of the output power cable 24 of the power integrated board 20, so as to constitute a modular design that adopts a power integrated board to fit the connection of power cables of different specifications, and thus the present invention complies with the patent application requirements.

While the invention has been described by means of specific embodiments, numerous modifications and variations could be made thereto by those skilled in the art without departing from the scope and spirit of the invention set forth in the claims.

What is claimed is:

1. A modular power integrated board, comprising:

a power integrated board, having a plurality of power pin holes thereon;

a plurality of first conductive connecting members, each having a first electric connecting portion fixed to said power pin holes and a second electric connecting portion electrically coupled to said first electric connecting portion; and a plurality of power cables, each of the power cables connected to a plurality of connectors and having at least one second conductive connecting member, and said second conductive connecting member having a third electric connecting portion electrically coupled to said second electric connecting portion and a fourth electric connecting portion electrically coupled to said third electric connecting portion and coupled to said power cable;

wherein said plurality of power pin holes can be divided into a plurality of potential areas with different voltage levels.

2. The modular power integrated board of claim 1, wherein said fourth electric connecting portion is capable of accommodating and connecting a plurality of power cables at the same time.

* * * * *